US005839688A

United States Patent [19]

Hertel et al.

[11] Patent Number: 5,839,688

[45] Date of Patent: Nov. 24, 1998

[54] METHOD AND APPARATUS FOR PRODUCING A ROLL OF BATHROOM TISSUE OR KITCHEN TOWELING WITH A PATTERN BEING REPEATED BETWEEN EACH PAIR OF TRANSVERSE PERFORATIONS

[75] Inventors: James E. Hertel; Lawrence D. Mikulsky; Richard J. Vigneau, all of Green Bay, Wis.

[73] Assignee: Paper Converting Machine Co., Green Bay, Wis.

[21] Appl. No.: 907,572

[22] Filed: Aug. 8, 1997

[51] Int. Cl.[6] ..... B65H 35/04

[52] U.S. Cl. ..... 242/523.1; 242/533.2; 226/28; 226/30; 83/74

[58] Field of Search ..... 242/523, 523.1, 242/533.4, 533.5, 542, 542.1, 542.2, 542.3; 226/28, 30; 83/74, 75, 371

[56] References Cited

U.S. PATENT DOCUMENTS

| | | | |
|---|---|---|---|
| Re. 28,353 | 3/1975 | Nystrand et al. . | |
| 2,237,759 | 4/1941 | Kwitek | 242/523 |
| 2,576,529 | 11/1951 | McKenney et al. | 83/75 |
| 2,769,600 | 11/1956 | Kwitek et al. . | |
| 2,870,840 | 1/1959 | Kwitek . | |
| 2,995,314 | 8/1961 | Nystrand . | |
| 4,104,723 | 8/1978 | Tokuno et al. | 83/74 |
| 4,361,260 | 11/1982 | Hanlan | 226/30 |
| 4,687,153 | 8/1987 | McNeil | 242/523.1 |
| 4,723,724 | 2/1988 | Bradley . | |
| 4,781,090 | 11/1988 | Feldkamper et al. | 83/74 |
| 4,781,317 | 11/1988 | Ditto | 83/74 |
| 4,828,195 | 5/1989 | Hertel et al. . | |
| 4,955,265 | 9/1990 | Nakagawa et al. | 226/28 |
| 5,045,135 | 9/1991 | Meissner et al. | 156/64 |
| 5,137,225 | 8/1992 | Biagiotti | 242/533.2 |
| 5,248,106 | 9/1993 | Biagiotti | 242/523.1 |
| 5,370,335 | 12/1994 | Vigneau . | |
| 5,505,405 | 4/1996 | Vigneau . | |
| 5,568,767 | 10/1996 | Jackson | 101/226 |

*Primary Examiner*—John P. Darling

[57] ABSTRACT

A method and apparatus for producing a roll or log of bathroom tissue or kitchen toweling with a pattern being repeated between each pair of transverse perforations wherein an extensible web having a pattern thereon repeated at equally longitudinally spaced position is advanced along a path toward a rewinder having a knife-equipped perforator and a cutoff mechanism. A detector senses the position of each pattern and also sensed is the position of the perforation knife with the positions being reported to a controller. The perforation knife is adjusted to insure that each perforation is between pattern positions and the cutoff mechanism is adjusted to stay in time with the transverse lines of perforations to provide a selected count of patterns in each winding cycle.

24 Claims, 8 Drawing Sheets

METHOD AND APPARATUS FOR PRODUCING A ROLL OF BATHROOM TISSUE OR KITCHEN TOWELING WITH A PATTERN BEING REPEATED BETWEEN EACH PAIR OF TRANSVERSE PERFORATIONS

BACKGROUND

This invention relates to a rewinding method and apparatus for producing tissue or towel products and, more particularly to a rewind wherein the operation features a method and apparatus to keep the perforation, cutoff, transfer, and wind cycle in registration with the printing on the web material.

Production of toilet tissue and household towel has for many years been decorated by printing single or multiple ink colors in many graphical patterns or shapes. These prints are applied to the paper either as part of the winding operation, or in a separate operation before parent rolls are rewound into commercial size products. The printing can be done with single ply or multiple plies, before or after embossing, laminating, ply bonding, or calendaring. The printing is always done however before it is rewound into commercial size rolls which are perforated for single sheet tear off.

The problem with the previous rewinding machines is that with normal tension variations seen in unwinding parent rolls of paper, the print repeat patterns change in length as the paper enters the rewinder. While these changes are usually small from sheet to sheet, over the length of a commercial size finished roll this can easily amount to several percent of the total length. As a result this would limit many different patterns such as logos, sceneries, and art works from being placed on a single perforated sheet. Even if the print repeat was designed to match the perforation length, variations in the paper made this an impractical task, the operator cannot constantly stop and adjust the perforation.

Until now it has not been possible to print a pattern on tissue or towel paper and then perforate it so that the perforation remains in register with the printed pattern throughout the entire log/roll. Where the transverse lines of perforation properly flank the printed pattern in one longitudinal position of the web being wound into the log, they may intersect or even bisect the pattern in another position—principally due to the variable extensibility of webs under tension, generally 2–10%.

On the other hand, it has been possible for quite some time to maintain print to cut-off in single sheets—for example, U.S. Pat. No. 5,568,767 and the art cited therein. Also pertinent for varying the cutoff in other but related products is co-owned U.S. Pat. 5,045,135 relating to diapers.

SUMMARY OF INVENTION

In the operation of the invention, the web is unwound from a source such as a jumbo parent roll which either has been pre-printed, or printed in the rewinder line, and proceeds into the rewinder. Upon reaching the rewinder it makes contact with typically one or two draw rolls equipped with a high friction surface, or nipped closely together to isolate the tension. Thereafter the web travels through the perforator which is equipped with a position feed back signal and means to change the rotational position of the perforator roll knife relative to the web. The web then continues on to the winding drums in the case of a surface winder, or to the winding mandrel in the case of a center winder. The winding drums or mandrels are also equipped with feed back signal means to change their rotational position relative to the web.

The rewinder may also be equipped with a photoelectric means to detect the printed pattern and, in particular, the repeat position already on the web material. This printed pattern may also be equipped with non-visual pattern or mark such as UV ink. Although the photoelectric means is normally located downstream of the draw rolls, it could also be placed upstream of this position. Typically, a position close to the perforator provides the most consistent and accurate readings.

As the printed web enters the rewinder, the print registration mark or pattern is detected. It is then compared to the perforator knife position by a controller. If the perforator knife roll position is off the predetermined or nominal position, the controller changes the perforator knife roll rotational position accordingly. Means to change the rotational position of the perforator knife roll may be electrical, mechanical, hydraulic, servo, or a combination thereof. Servo motor drives are a common means to quickly make these changes. Alternately, the perforating unit can be moved in the web direction to accomplish the same result.

When the perforation is adjusted to the print, the actual perforation spacing is changed. Thus it is possible to see both long and short perforation lengths in a single roll. It is also possible to have all long or all short lengths in one roll. Over a complete cycle, this may increase or decrease the total length to be wound. If the total length changes the winder cutoff and transfer must also be phased so as to get a predetermined "count" or number of connected sheets.

The phasing of the cutoff and transfer is done by the controller which monitors the actual print registration. As the winding progresses the changes in perf to print register are accumulated and a corresponding signal is given to advance or retard the cutoff components—in the case of a center winder, the winding mandrels and cutoff and transfer mechanism.

In a center winder the cutoff device, typically a bedroll and chopper roll, or pad cutoff device are used to sever the web. In the metered wind system we use, the system is phased to the start of the cycle which is the cutoff. Thereafter, the mandrel typically goes through a rapid deceleration speed profile to properly control the tension while winding.

In a surface winder the automatic phasing of the cutoff includes the cutoff device and/or the core inserter. In some surface winders, the core inserter and core are used to sever the perforation. In others a separate device like a cutoff roll or a pad device is used to sever the web. And in still another type the core insertion means is used to locate the core in a precise position to the severed web.

Our method of perf-to-print registration provides a constant number of sheets in the roll, and varies the perforation length to keep it in a constant location to the print. The overall result of total product length (start of roll to end of roll) may be longer or shorter. Other objects and advantages may be seen in the following description.

DETAILED DESCRIPTION

Figure 1:
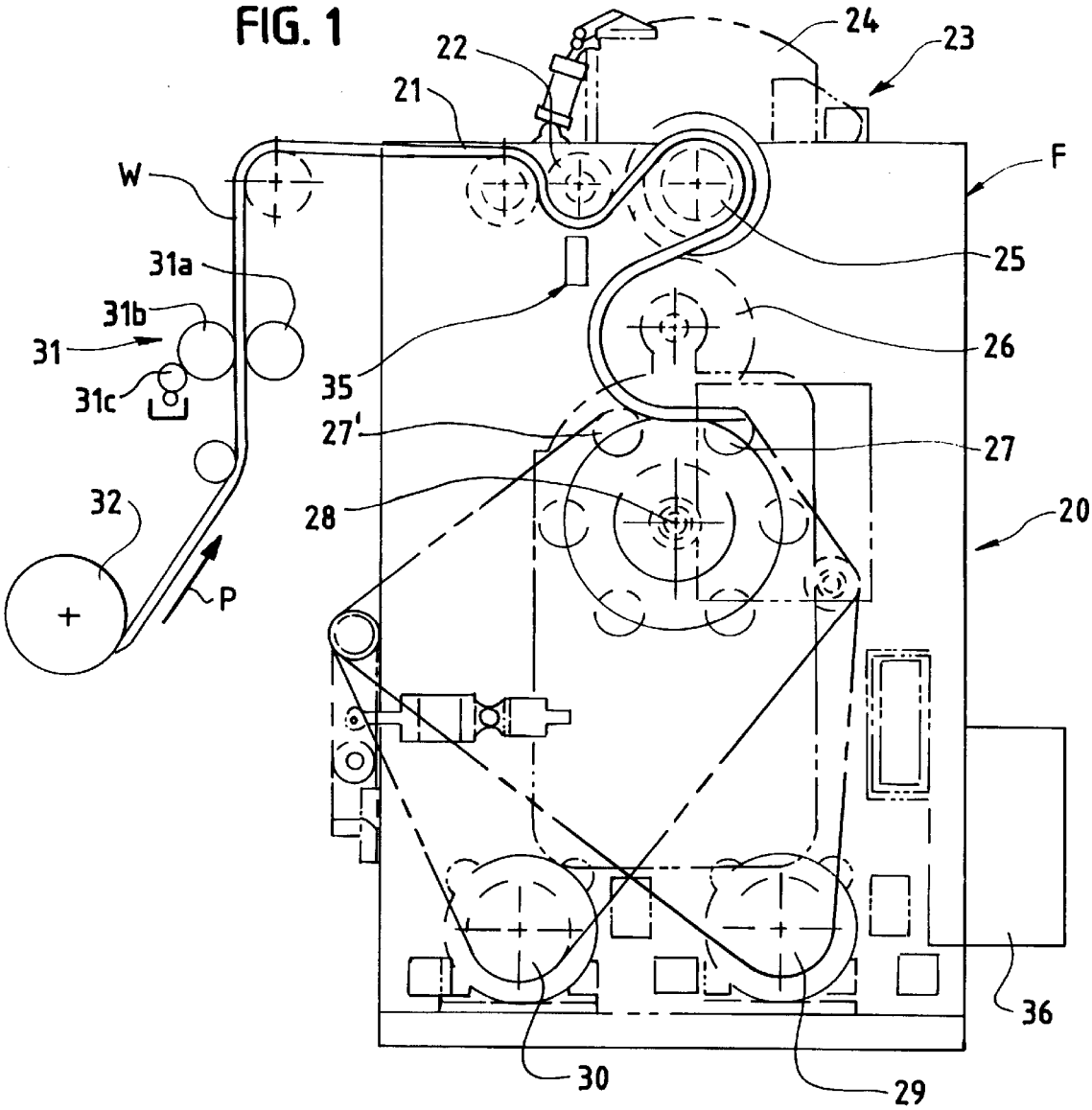
FIG. 1 is a side elevational view somewhat schematic of a first form of center rewinder—this being marketed by the assignee hereof, Paper Converting Machine Company, of Green Bay, Wis. under the tradename CENTRUM™.

In the illustration given in FIG. 1, the numeral 20 designates generally a center winder of the general type shown and described in co-owned U.S. Pat. No. RE. 28,353 and wherein a web W is advanced along a path P by draw rolls 21, 22 (upper left center) and into a perforator generally designated 23. The perforator 23 includes a stationary bar 24 and a knife roll 25 all of the general type shown and described in co-owned U.S. Pat. No. 2,870,840.

After passing through the perforator 23, the web is partially wrapped around bedroll 26 and thereafter sequentially wound on a plurality of mandrels 27 rotatably mounted on a turret 28. The mandrels are of the metered winder type shown and described in co-owned U.S. Pat. No. 2,995,314 as by motor/drive systems 29, 30.

Briefly, the metered winding involves decelerating the mandrel 27 being wound while the mandrel 27' next in line is being accelerated. At the conclusion of the wind, a chopper knife and transfer pads issue from the bedroll 26 to effect transfer of the web W from mandrel 27 to mandrel 27'—all as described in the above mentioned U.S. Pat. No. RE. 28,353.

What is new herein is the ability to maintain a repeating pattern between adjacent perforations—and while maintaining a predetermined or predicted "count". Count refers to the number of "sheets" or "squares" in the roll product—in the United States this is typically 4½"×4½" for bathroom tissue and 11"×11" for kitchen toweling. For example, the bathroom tissue roll product may be "250 count", viz., having 250 connected squares or sheets.

In FIG. 1, the numeral 31 designates generally a printing press for applying the repeating pattern. It is to be understood however, that the web may be printed before parent roll 32 is brought to the rewinder 20, i.e., being printed "off line". When printed on line as in FIG. 1, the numeral 31*a* designates a backing roll, the numeral 31*b* the plate roll and 31*c* the ink applicator roll.

Figure 4:
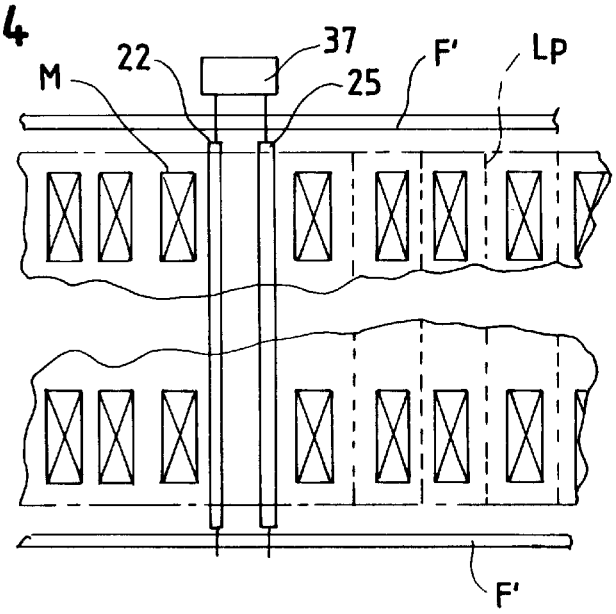
FIG. 4 is a portion of FIG. 3 showing how the invention maintains proper print to perf registration with greatly exaggerated pattern spacing.

All of the other elements described thus far are seen in FIG. 1 and are supported on the machine frame F. The machine frame F includes the usual side-frames F' as seen in FIG. 4. These rotatably support the various rotating members and elements. Also shown in FIG. 5 but not seen in FIG. 1 are the core feed 133 and log stripper 134. These generally have been used for a long time—see, for example, co-owned U.S. Pat. No. 2,769,600.

Print to Perf Registration

Center Rewinders

The invention starts off by checking the relationship of the register mark position or mark M (see FIG. 4) to the position or orientation of the knife of the perforation roll 25. Essentially, this mark M is sensed by the detector generally designated 35—see the upper left center of FIG. 1. This, in combination with the controller 36—see the right center of FIG. 1—and the servo-drive 37 for the knife-equipped perforator roll 25—see the upper part of FIG. 4—will develop the proper spacing of lines of transverse perforation Lp as seen in the right hand portion of FIG. 4. There the spacings are highly exaggerated to indicate the ability of the invention to maintain perf-to-print register, i.e., within about 1/16" (1–2 mm).

A suitable print registration detector 35 is a Registron S-2000 system manufactured by Bobst Group, Inc., Roseland, N. J. 07068. A suitable controller 36 or processor for closed loop calculations is a Giddings & Lewis PIC 900 manufactured by Giddings & Lewis, Inc., Fond du Lac, Wis.

The invention includes two interrelated steps—the proper placement of the transverse lines of perforation and the operation of the rewinder to provide exact count. The first step is similar in all four rewinder embodiments. For example, in the KORLEUS rewinder of FIG. 5, a detector 135 detects the location of the pattern or mark on the web W as it passes through the draw rolls 121, 122 and this relative to the orientation of the knife in the perforator roll 125. Through the cooperation of the detector 135 and the controller 136, the knife in the roll 125 is oriented to engage the anvil portion of the perforator along a line between adjacent patterns so as to preserve their integrity.

The orientation of the perforator roll 125 is dictated by the controller 136 which in turn delivers a signal to a servo drive 137 (see FIGS. 5 and 6) operatively coupled to the motor of the perforator roll 125.

Figure 12:
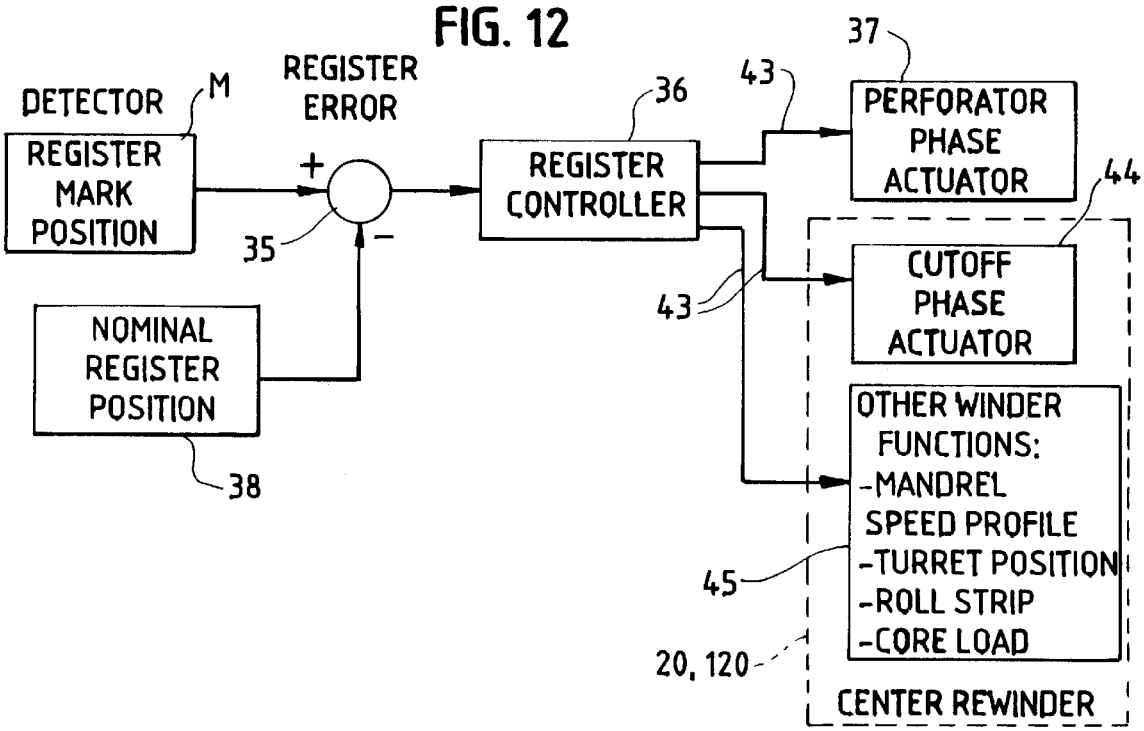
FIG. 12 is a block diagram of controls used to advantage in a center rewinder.

The operation of this phase of the invention is depicted in FIG. 12 where the detector 35 receives input from the register mark position or pattern M and compares it with a nominal register position 38 after which the combined output is delivered to the register controller 36. An output is delivered to the perforator phase actuator 37—hereinbefore described as the servo-drive for the perforator motor.

Surface Rewinders

As indicated previously, the same operation is performed relative to the surface winders. For example, in FIG. 7, a web W is advanced through draw rolls 221, 222 and the mark or pattern thereon is sensed by the detector 235. Thereafter, the web proceeds through the perforator 223 and thereafter into another pair of draw rolls 238 and 239. The web then passes through the throat between the upper winding drum 240 and the lower winding drum 241. This results in a log product L which is controlled in typical fashion by the rider drum 242. In the FIG. 7 embodiment we provide a positionable anvil 224 for the perforator means—here illustrated as four-position anvil to facilitate changing of the perforation spacing independently of the means described in connection with the instant invention. This coacts with the knife-carrying perforator roll 225.

Figure 7:
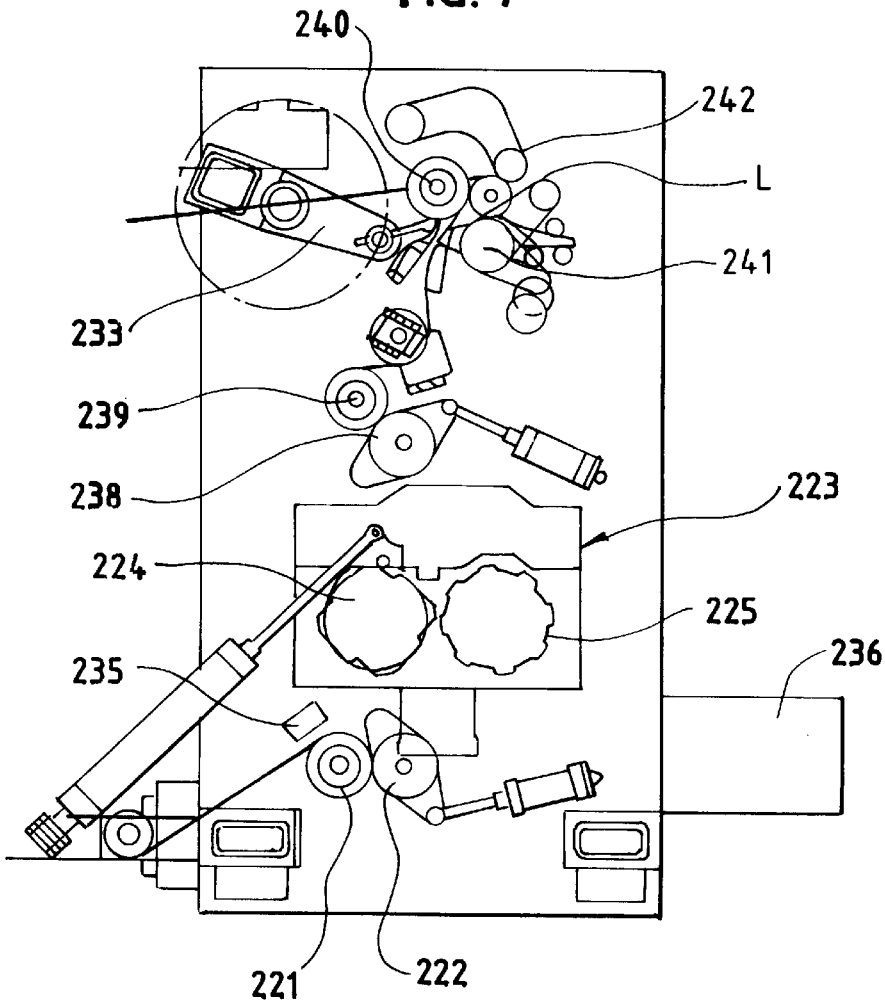
FIG. 7 is a schematic side elevational view of a surface winder also marketed by the assignee thereof, and under the tradename QUANTUM™.
Figure 8:
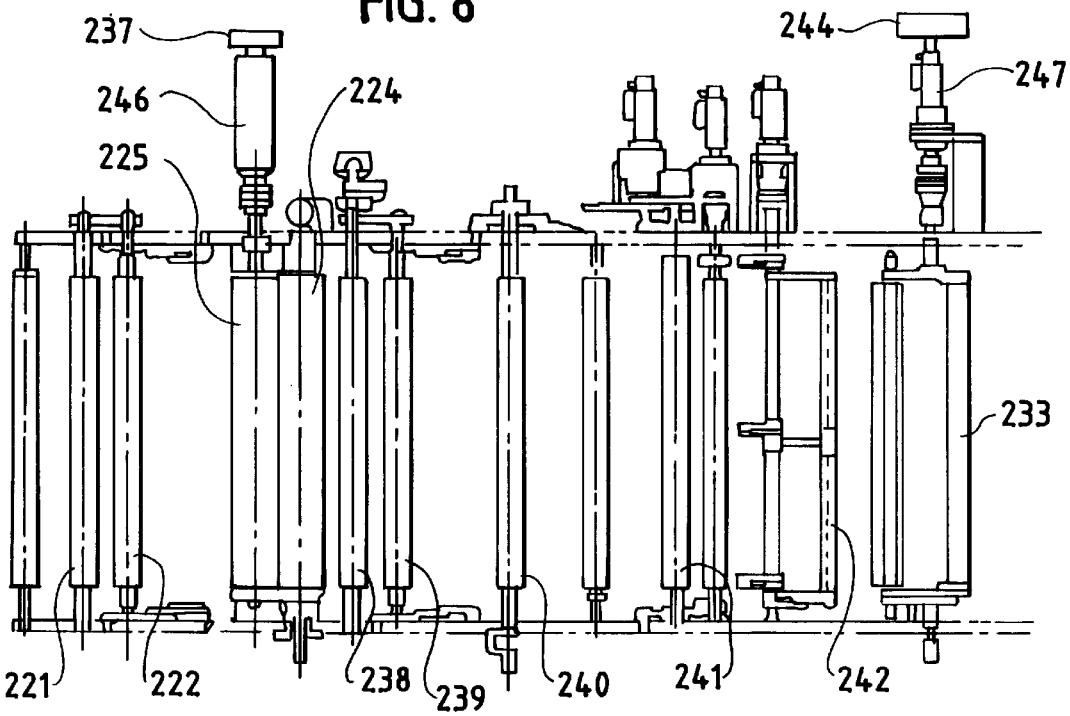
FIG. 8 is a developed schematic plan view of the rewinder of FIG. 7.
Figure 13:
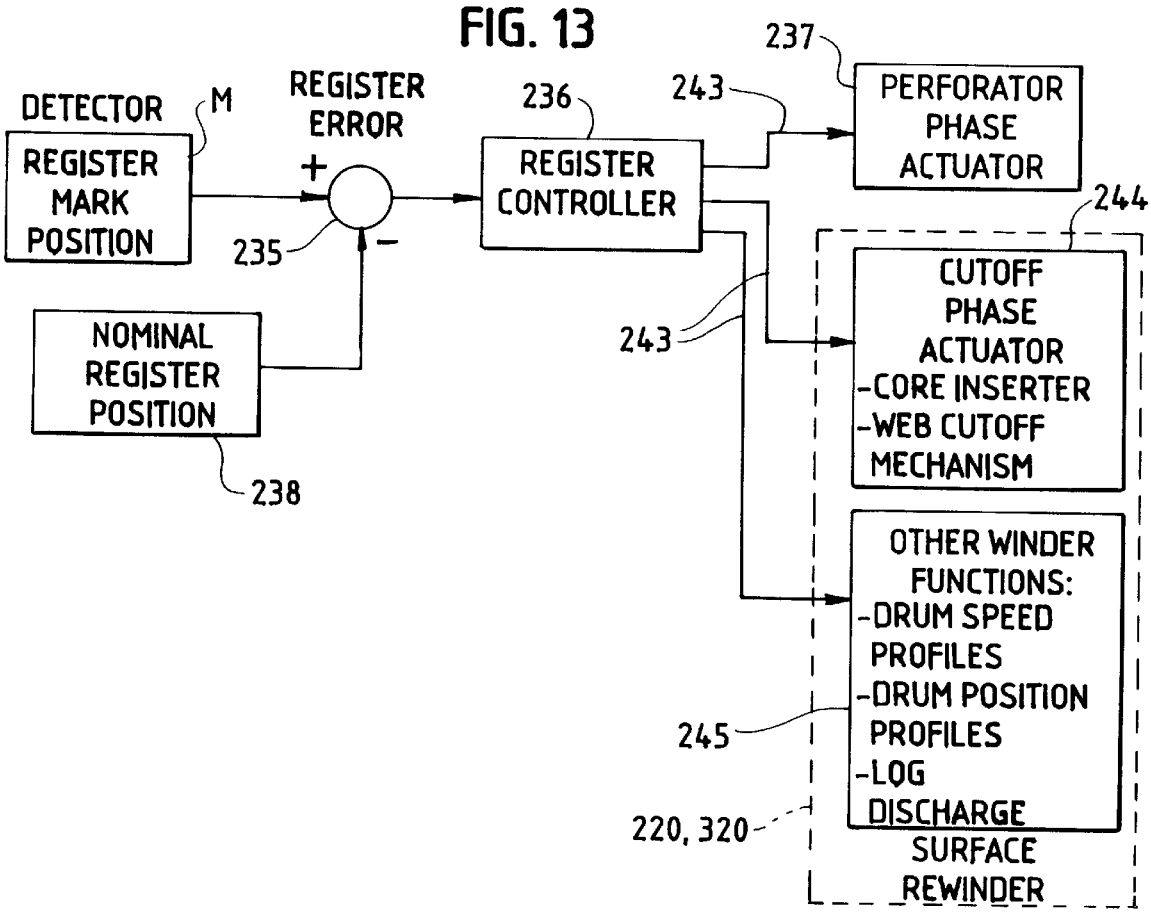
FIG. 13 is a block diagram of controls used to advantage in a surface winder.

The portion of the control diagram for a surface winder associated with the QUANTUM™ surface winder of FIGS. 7 and 8 is seen in FIG. 13. Again, there is a detector as at 235 which receives input from a pattern or register mark position M comparing the same with a nominal register position 238 and develops an output that goes to the register controller 236. Thereafter a signal is delivered to the perforator phase actuator 237.

Figure 10:
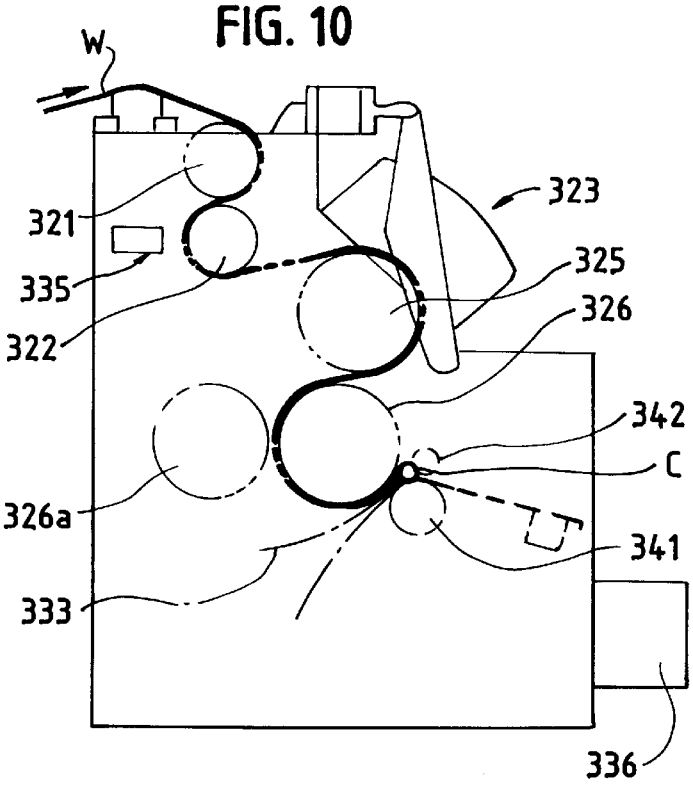
FIG. 10 is a schematic side plan view of another surface winder also marketed by the assignee thereof, and under the tradename MAGNUM™.
Figure 11:
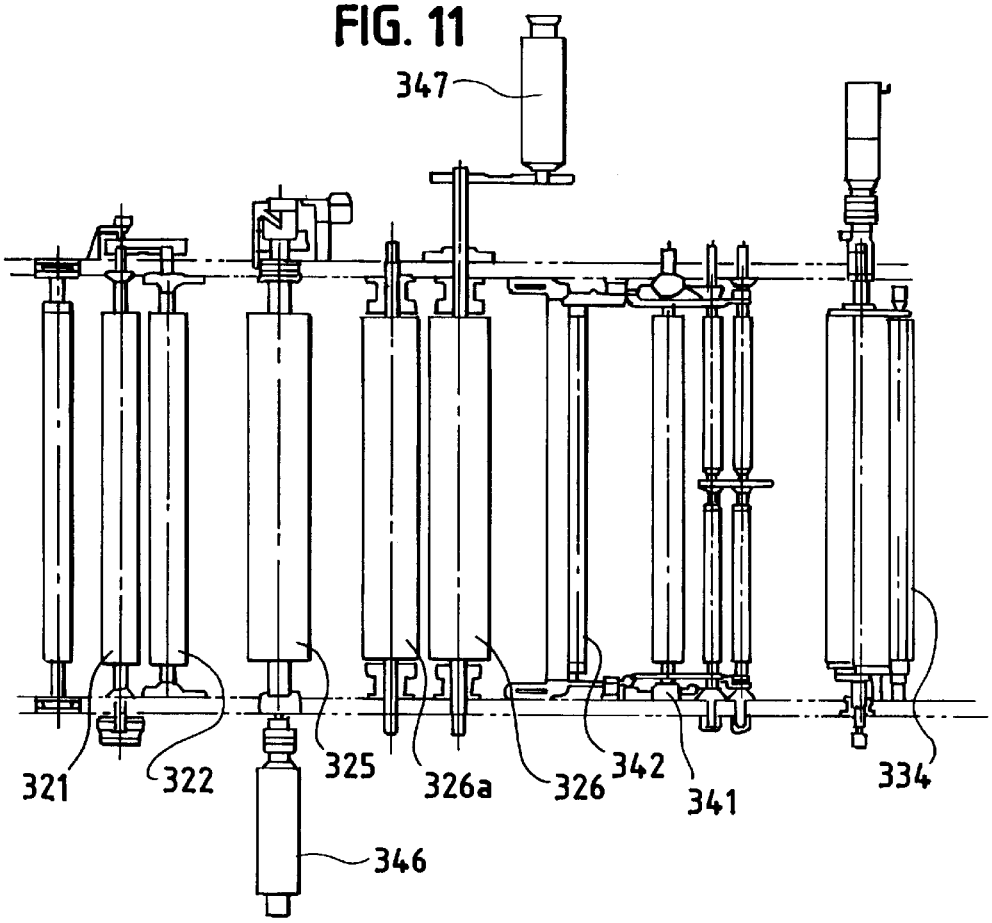
FIG. 11 is a developed plan view of the rewinder of FIG. 10.

Relative to the MAGNUM™ type surface winder seen in FIGS. 10 and 11, the web W proceeds through draw rolls 321 and 322, being detected by the detector 335. The cooperation between the detector 335 and the controller 336 orients the knife roll 325 of the perforator 323 so as to again develop lines of transverse perforation between adjacent patterns.

In the MAGNUM™ type rewinder of FIGS. 10 and 11, the web W, after passing through draw rolls 321, 322 is partially wrapped on the rotating knife-carrying perforator roll 325 of perforator 323. It then passes around a bedroll 326 which also serves the same purpose as the upper winding drum 240 of the three drum cradle of the QUANTUM™ surface rewinder of FIGS. 7 and 8.

To sever the web at the desired line of perforation in the MAGNUM™, a chopper roll 326*a* cooperates with the bedroll 326. The remaining parts of the three drum cradle are the lower winding drum 341 and the rider drum 342. A hypocycloidal core feed is provided at 333—much the same as that indicated at 233 in FIG. 7. This is fully described in co-owned U.S. Pat. No. 4,723,724.

REWINDER OPERATION CONTROL

The second phase of the invention relates to the control of the rewinder so as to develop an exact "count". This requires that the register controller 36, 136, 236, 336, as the case may be, accumulate the incremental displacements of the lines of perforation $L_p$ throughout the prescribed number of patterns—alternatively squares or sheets. Thus, as indicated above, the exact count may result in a roll or log length of web which is more, less or the same as the nominal length. Again, the principal factor is attributable to the web itself and, more particularly, its stretch under tension conditions.

To insure that there is the exact cutoff, signals 43 (see FIG. 12) are delivered from the register controller 36 to both the cutoff phase actuator 44 and the means for controlling other winder functions 45.

In the illustration given in FIG. 12, the signal is delivered to the cutoff phase actuator 44 (such as a servo drive) which is coupled to the cutoff and transfer roll 26 which performs the actual cutoff and transfer.

Simultaneously, however, the signal along the line 43 is also delivered for controlling other winder functions which, include the mandrel speed through means (such as servo drives) operably coupled to the metered winding motor-drives 29, 30, the turret 28 and the core feed and log stripper. These elements can be seen in the KORLEUS™ form of surface winder in FIG. 5 where the core feed 133 operates on the core C and the log stripper 134 operates on a Log L.

Center Rewinders

Figure 2:
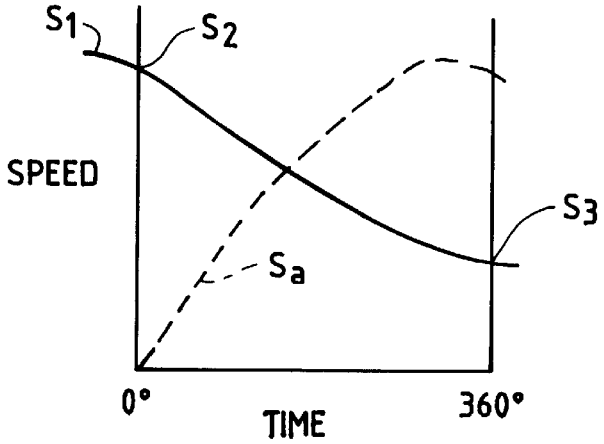
FIG. 2 is a chart showing the mandrel speed in the rewinder of FIG. 1 when employing metered winding of the type generally described in U.S. Pat. No. 2,995,314.

Reference is now made to FIG. 2 which shows a typical speed profile for a mandrel in the process of winding a log of bathroom tissue or kitchen toweling. The abscissa is time and the period graphed is slightly over one cycle. A cycle may be of the order of two seconds at 30 logs/minute. In the typical metered winding operation, the mandrel about to be wound is brought up to a speed SI just prior to cutoff and transfer. The controlling motor drive 29 or 30 then starts to decelerate the mandrel 27 (see FIG. 1) to achieve a predetermined speed at transfer $S_2$. Deceleration continues through most of the rest of the wind until cutoff $S_3$.

Meanwhile the mandrel 27' (again see FIG. 1) is accelerating to be ready for transfer. This is shown by the dashed line speed profile $S_a$ in FIG. 2. A typical speed profile for the accelerating mandrel starts at zero because it had to be stopped for log stripping and core ensleeving. The mandrel 27' is driven during the period illustrated in FIG. 2 by that one of the controlling motor drives 30 or 29 which is not driving the mandrel 27. In many instances the motor drives illustrated in U.S. Pat. No. 2,995,314 have been replaced by electronic drives, but the overall function is the same.

Figure 2A:
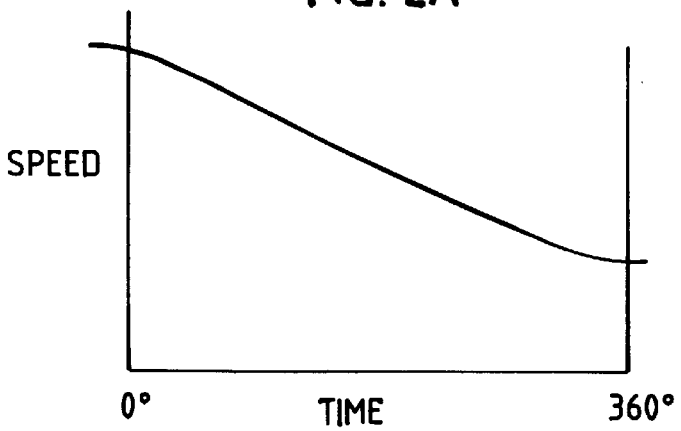
FIGS. 2A and 2B show variants of the metered winding profile under different print repeat stretch.
Figure 2B:
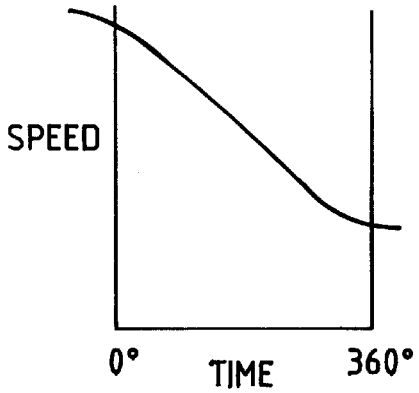

The FIG. 2 showing could be a typical speed profile for a metered winding operation where there is no concern about the spacing of the transverse lines of perforation $L_p$. However, the invention addresses the phenomenon of variable stretch of paper and like webs under tension. This stretchability, i.e., elongation, may vary as much as 6% to 10%. Thus, the amount of time it would take to wind a 6% stretched web is less than it would take to wind the "longer"—or 10% stretched web. The problem becomes complicated because the stretch in one longitudinal part of the web may be different from that in other parts. So there has to be instantaneous changes in the number of functions—not only the time required for the wind—but also the functions which are related to cutoff and transfer, i.e., those relating to the end of one wind and the beginning of the subsequent wind. These two different situations are illustrated in FIG. 2A (longer wind) and in FIG. 2B (shorter wind). As indicated, this can be achieved by changing the slope of the deceleration portion of the profile through suitable means such as servo motors or electronic programming for the functions indicated at 37, 44, 45 in FIG. 11.

So, in addition to changing the speed of the cutoff and transfer bedroll 26—as by relative slippage between it and the web, and the mandrel speed profile just described, there must be correlating of the rotation of the turret 28, the core feed 33 and the log stripper 34.

Figure 5:
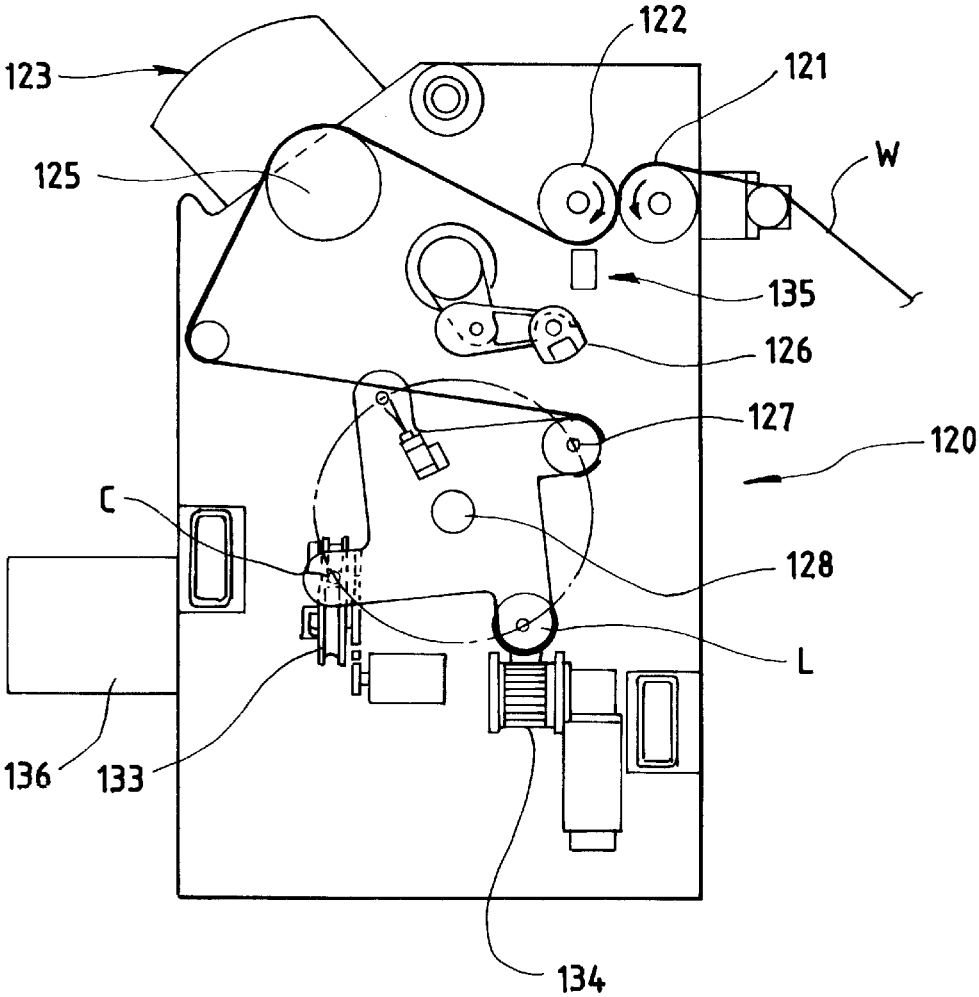
FIG. 5 is a schematic side elevational view of another center winder also marketed by the assignee hereof, and under the tradename KORLEUS™.
Figure 6:
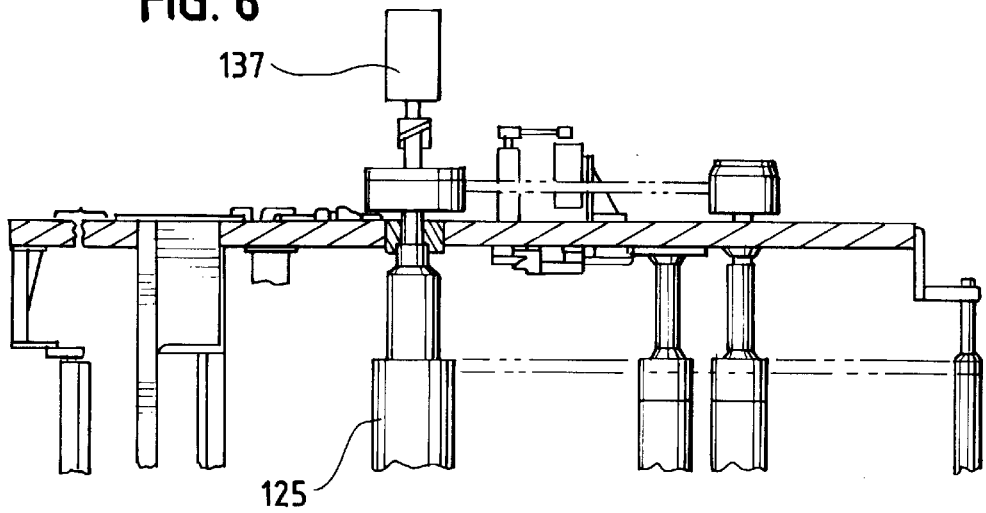
FIG. 6 is a fragmentary, developed schematic plan view of a portion of the rewinder of FIG. 5.

Analogous changes are made to the winder operation of the KORLEUS™ rewinder of FIGS. 5 and 6. These fairly well parallel the changes described for the CENTRUM™—except in the case of the cutoff and transfer mechanism 26. Here, the KORLEUS™ uses an articulatable arm means 126 (see the upper right center of FIG. 5). Inasmuch as this is a rotating member, it can be controlled precisely by a servo motor to effect cutoff and transfer at the predetermined line of perforation. Further details on the articulatable arm means 126 and the KORLEUS™ rewinder 120 generally can be seen in co-owned, co-pending application Ser. No. 08/589,049 filed Jan. 17, 1996.

Surface Rewinders

A similar control is provided for the surface winders seen in FIGS. 7–11. There the control signal comes from the registration controller 236 via the line 243 (referring to FIG. 13) which delivers a signal for cutoff generally indicated by the box 244. This may be in terms of a core inserter as at 233 (see the upper central portion of FIG. 7) or a chopper roll 326*a*—see the left central portion of FIG. 10. These are generally operated by drives and programmed by the controller 236. Thus, either servo motors or electronic programming can be used to advantage to control these cutoff functions.

Other winding functions are also simultaneously controlled by the signals 243 among which are matters such as the lower speed profile (see FIG. 9) which is illustrated by the box 245 in FIG. 13. As in the case of FIG. 2, there are two variations as at FIGS. 9A and 9B from the nominal operation shown in FIG. 9 which reflects the structure and operation described in co-owned U.S. Pat. No. 5,370,335. Again, the adjustment due to a positive incremental difference over nominal (FIG. 9A) or a negative incremental difference relative to nominal (FIG. 9B) is achieved during the acceleration stage A of the lower winding drum 341 although it is also possible to vary this somewhat through the providing of a profile on the rider drum 342. The rider drum 342 and the lower winding drum 341 cooperating with the upper winding drum or bedroll 326 in developing the log to be wound on the core C—still referring to FIG. 10.

Figure 3:
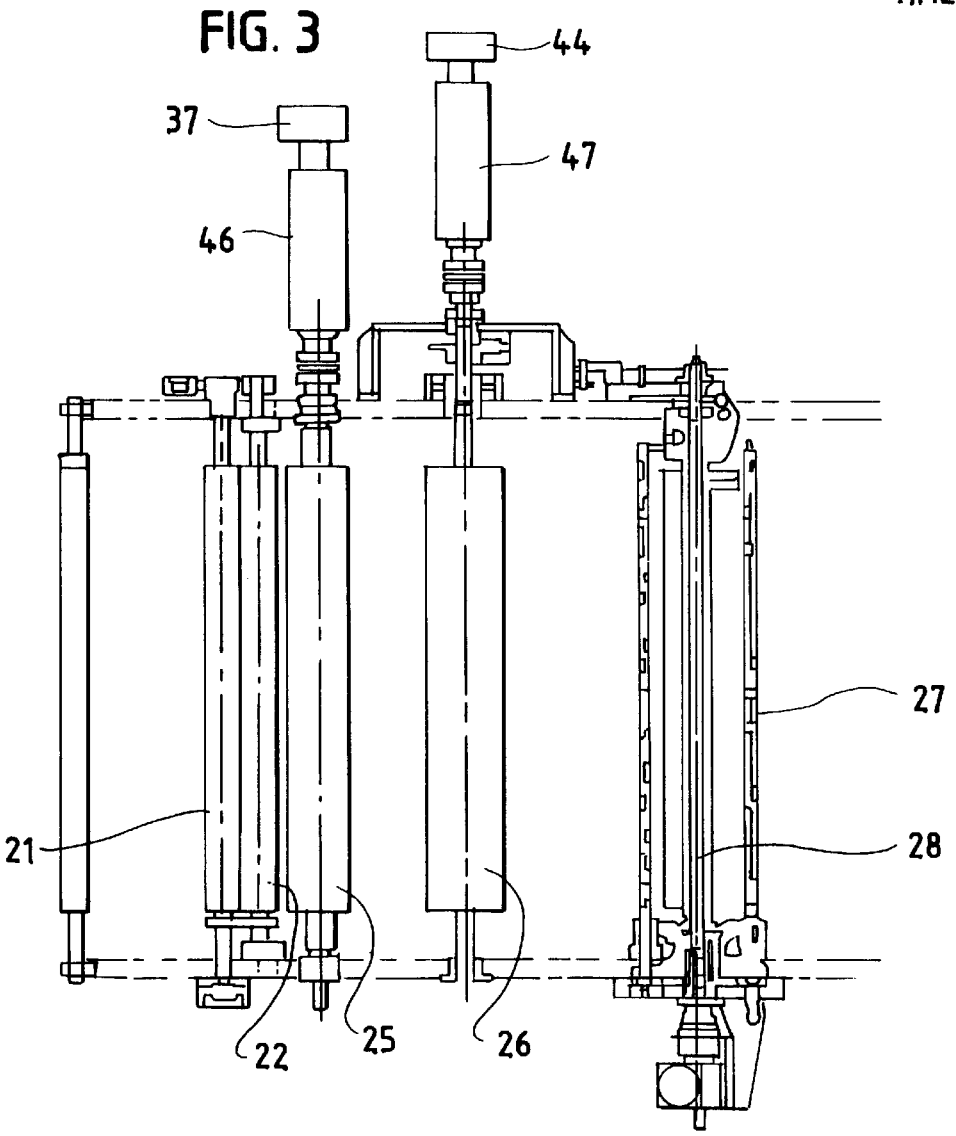
FIG. 3 is a developed plan view of the rewinder of FIG. 1 and also somewhat schematic.

For each side elevation of a rewinder, we provide a developed view as at FIGS. 3, 6, 8, and 11. In FIG. 3, for example, we show a motor 46 for driving the perforator knife roll 25. The motor 47 drives the bedroll 26 which implements the cutoff and transfer. Operatively connected to the perforation motor 46 is the perforator phase actuator or servo-drive 37 described previously in conjunction with FIG. 12. In similar fashion, the cutoff phase actuator or servo-drive 44 is operatively associated with the cutoff and transfer bedroll motor 47. Similarly, in FIG. 6, the servo drive or perforation phase actuator 137 is operatively coupled to the perforator bedroll 125.

For the surface type of rewinder, the perforation incremental adjustment is similar. By reference to FIG. 8, it will be seen that there is a motor 246 which is coupled to the perforator bedroll 225. Operatively connected to the motor 246 is the perforation phase actuator 237 which advantageously, again, may take the form of a servo drive. Further, a motor 247 is provided to drive the core inserter or hypocycloidal feed 233. Operatively associated with the motor 247 is the cutoff servo drive means 244.

Lastly, relative to FIG. 11, a motor 346 drives the perforator bedroll 325 and, as in the case of the QUANTUM™ type of rewinder seen in FIG. 8, has associated therewith a perforation phase actuator (not shown in FIG. 11). Also, in similar fashion, the upper winding drum or bedroll 326 is driven by a motor 347—also operatively tied in to the controller 336 as in the case of the FIG. 8 showing.

FIG. 14

Figure 14:
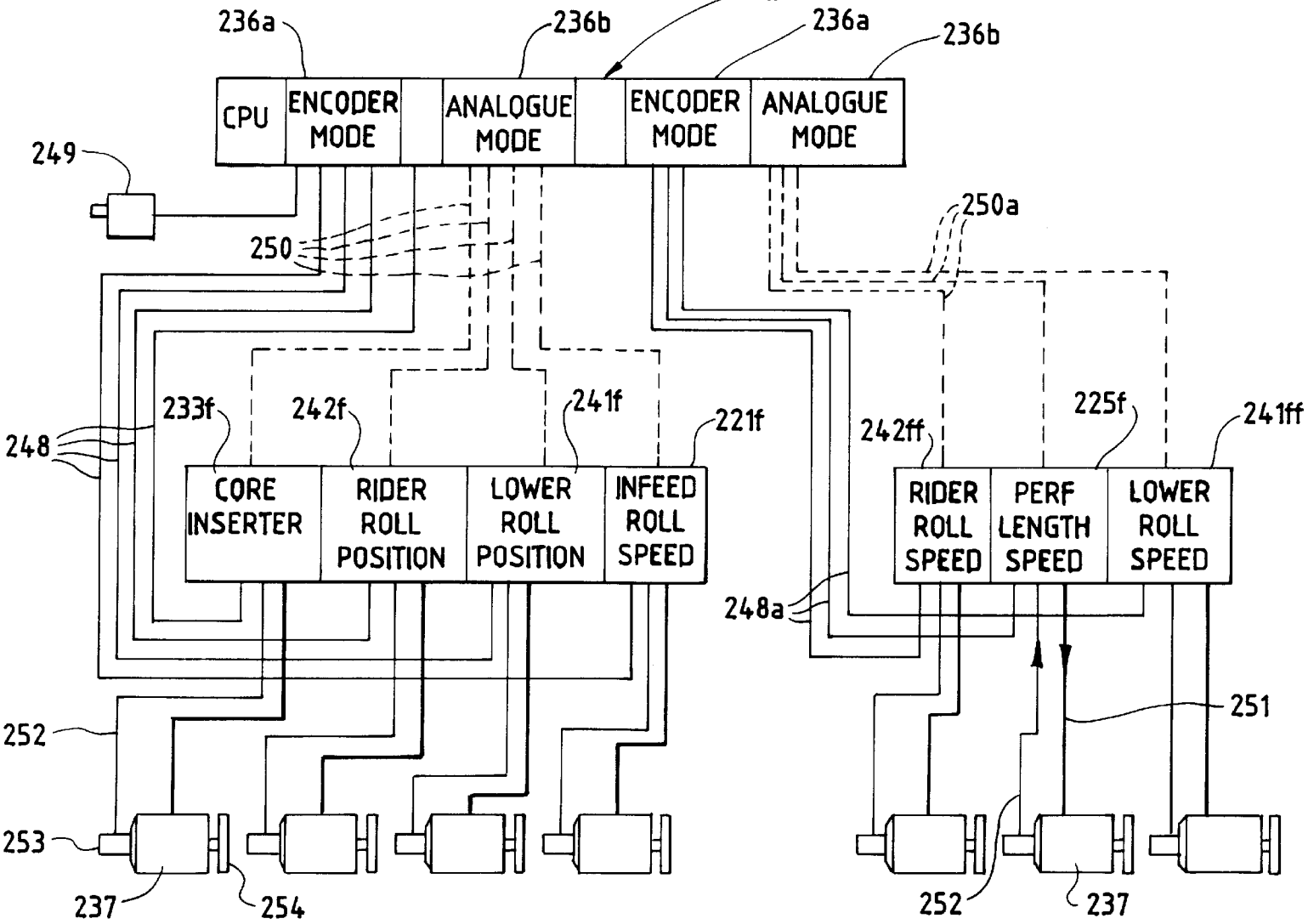
FIG. 14 is an electrical schematic diagram such as applied to the QUANTUM™ type surface rewinder of FIGS. 7 and 8.

A typical electrical wiring diagram is seen in FIG. 14 and this one pertains particularly to the QUANTUM™ type of rewinder described in conjunction with FIGS. 7 and 8. Therefore, the numeral 236 designates generally the controller or CPU which, for clarity of presentation, consists of an encoder module 236*a* and an analog module 236*b* for each of the two groups of amplifier units. The functions of the left hand group of amplifier units pertain to the core inserter designated $\mathbf{233}_f$, the position of the rider roll designated $\mathbf{242}_f$, the position of the lower winding drum designated $\mathbf{241}_f$ and the speed of the infeed draw roll designated $\mathbf{221}_f$.

The right hand group of amplifier units includes the speed of the rider roll designated $\mathbf{242}_{ff}$, the speed of the perforation bedroll designated $\mathbf{225}_f$ and the speed of the lower winding drum designated $\mathbf{241}_{ff}$. Each one of these left hand amplifier units is coupled to the controller 236 by its own signal feedback line as at 248. In similar fashion, the right hand group of amplifier units are connected by feedback signal conducting lines 248*a*.

Also introduced into the controller 236 is the speed of the machine which is normally tied to the perforator master encoder 249. It will be appreciated that a series of drive motors are provided for the various drums, rolls, etc. and that these motors as at 246, 247 are incrementally controlled, i.e., advanced or retarded by means of the phase controls or servo drives 237, 244. In the illustration given, this is done by an analog command which here is shown as dotted lines as at 250 for the left hand group and 250*a* for the right hand group. Thus, depending upon what the feedback signal is, there is a voltage command delivered to the amplifier unit in question which then is delivered to the servo drive as at 237 in the lower right hand portion of FIG. 14. This is delivered via the line 251 whereas the servo motor encoder feedback signal is delivered back to the amplifier unit 225 via the line 252. Each servo-drive unit 237 has a terminal 253 for coupling to the line 252 and a drive portion 254 which couples to a particular motor for regulating the same.

SUMMARY

The invention can be quickly understood through the various steps performed in achieving "print to perf" registration in the cyclic production of logs of bathroom tissue or kitchen toweling with a pattern M repeated between each pair of adjacent lines of transverse perforation. These steps include (a) advancing along a path P toward a rewinder 20, 120, 220, 320 equipped with perforation means 23, 123, 223, 323 and cutoff means 26, 126, 226, 326 an elongated, extensible web W having a pattern M thereon repeated at equally longitudinally spaced positions, (b) sensing as by a detector 35, 135, 235, 335 the position of each pattern while generally simultaneously therewith sensing the position of the perforation means, (c) adjusting the perforation means to insure that each perforation is between pattern positions, and (d) adjusting the cutoff means to stay in time with perforations to provide a preselected count of patterns in each winding cycle. The invention also advantageously includes means for applying a speed profile cycle (FIGS. 4 and 9) on the winding means and for changing the profile to position a predetermined line of perforation at the knife or blade of the cutoff means at the end of each cycle.

The foregoing will be seen to be steps and elements common to both center and surface rewinders. Also applicable to both types is a print registration mark detection system for visual as well as non-visual ink marks. Further in each case, we provide for a perforator position, i.e., blade orientation feedback signal. This is simply designated by the double-arrowed line connecting the register controller 36 with the perforator phase actuator 37 in FIG. 12 and the similar line between elements 236 and 237 in FIG. 13.

In similar fashion we indicate that there is a cutoff device position feedback signal by applying arrows at both ends of the line connection the cutoff phase actuator 44 with the center winder 20, 120 in FIG. 12 and the actuator 244 with the surface winder 220, 320 in FIG. 13.

In the case of a center type rewinder 20, 120, we provide a frame equipped with a rotatable turret 28, 128 carrying a plurality of orbiting, rotatable mandrels 27, 127 with cutoff means 26, 126 being located adjacent the orbital path of the mandrels. The rewinder is also equipped with log stripping means 134. The winding function adjustment includes a controller for controlling the mandrel speed according to the FIG. 2 profile, the turret rotation and the log stripping means. Still further, the frame is advantageously equipped with core feed means as at 33, 133.

For the center driven type of rewinder, we provide a mandrel winding motor position feedback signal as well as roll strip conveyor position feedback signal and core feed or loading conveyor (if present) feedback signal—all of these being designated in FIG. 12 by the double-arrowed line connecting the center rewinder box 20, 120 with the "Other Winder Functions" box 45 in FIG. 12. This includes means to change the winding mandrel speed profile cycle to match the start of winding to the actual perforation position. It also includes means to change the core loading and roll stripping cycles to match the start of winding cycle changes.

Figure 9:
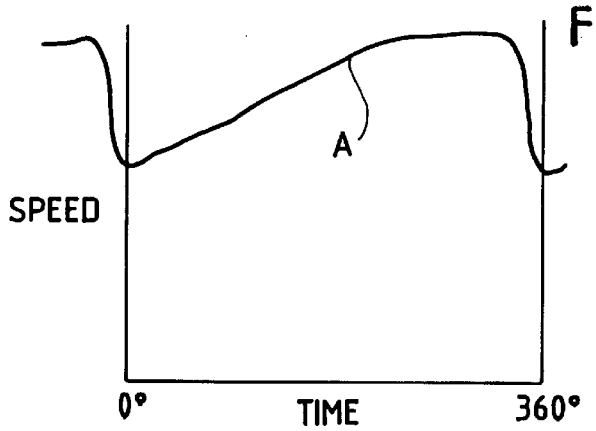
FIG. 9 is a chart similar to FIG. 2 showing the speed profile of one of the winding drums in the rewinder of FIGS. 7 and 8, FIGS. 9A and 9B show variants of the profile of the same drum under different stretchabilities.
Figure 9A:
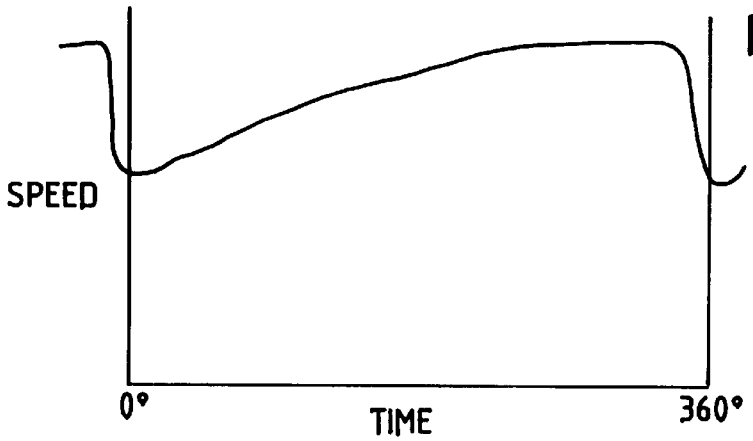
Figure 9B:
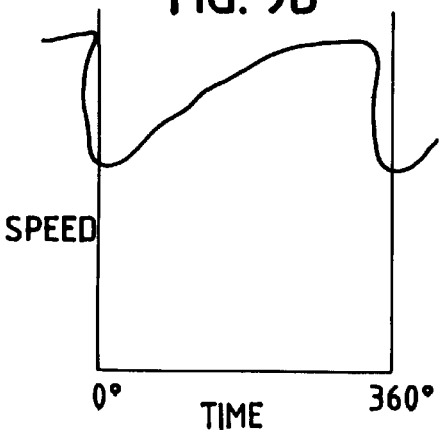

In the case of a surface type rewinder 220, 320, we provide a frame equipped with a pair of winding drums 240, 241 and a rider drum 242 arranged in a three drum cradle, the winding function adjustment includes controlling the speed of at least one of the drums according to the profile of FIG. 9. The speed profile of one of the winding drums is described in co-owned U.S. Pat. No. 5,370,335 while that of the rider drum is described in co-owned U.S. Pat. No. 5,505,405. More particularly, we provide means to change the speed profile of the lower winding drum to match the start of winding based on actual perforation position and/or means to change the speed profile of the rider drum to match the start of winding based on actual perforation position. Also in the surface winder we include core feed or insertion means 233, 333 for inserting a core in the nip between the winding drums.

Advantageously, we control the timing of the means 333 for insertion of the core to function as the cutoff means 226 as depicted in FIG. 7. More particularly, we provide means to change the timing of core feed relative to the perforation to be severed. This is also fully described in the above-mentioned U.S. Pat. No. 4,723,724. Still further, in the FIG. 7 illustration and the '724 patent, we provide means for clamping the web on opposite sides of a preselected line of transverse perforation to function as the cutoff means. And in both FIGS. 7 and 10, we provide one of the drums 240-2, 340-2 as a movable drum which moves once each cycle—as in co-owned U.S. Pat. No. 4,828,195.

As in the case of the center type rewinder, we provide a feedback signal by coupling the surface rewinder box 220, 320 with the other functions box in FIG. 13 by a double-arrowed line. More particularly this signal controls the operation of the motor means driving the winding drum with the speed profile—here the lower drum.

While in the foregoing specification, a detailed description of different embodiments of the invention have been set down for fully disclosing the invention, many variations in the details hereingiven may be made by those skilled in the art without departing from the spirit and scope of the invention.

We claim:

1. A rewinder for cyclically winding logs of bathroom tissue or kitchen toweling with a pattern repeated between each pair of adjacent lines of transverse perforation, comprising a frame having knife-carrying perforation means, winding means, phase actuation-equipped cutoff means and means for advancing a pattern-equipped extensible web along a path toward said perforation means, a detector a on said frame for sensing the position of each pattern relative to the position of the perforation means, a controller on said frame for adjusting said perforation means to insure that each perforation is between pattern positions including means for generating a perforator knife position feed back signal, and means operably associated with said controller and cutoff means for adjusting said cutoff means to stay in time with perforations to provide a preselected count of patterns in each winding cycle.

2. A method for cyclically producing logs of bathroom tissue or kitchen toweling with a printed pattern repeated between each pair of adjacent lines of transverse perforation, comprising advancing along a path toward a rewinder equipped with perforation means and cutoff means an elongated, extensible web having a pattern thereon repeated at equally longitudinally spaced positions, sensing the position of each pattern while generally simultaneously therewith sensing the position of said perforation means, adjusting said perforation means to insure that each perforation is between pattern positions, and adjusting said cutoff means to stay in time with perforations to provide a preselected count of patterns in each winding cycle.

3. The method of claim 1 including providing a center winding type of rewinder equipped with a rotatable turret carrying a plurality of orbiting, rotatable mandrels with said cutoff means being located adjacent the orbital path of said mandrels, also providing said rewinder with log stripping means, said adjusting steps including controlling the mandrel speed, the turret rotation and the log stripping means.

4. The method of claim 3 including providing a core feed for each of said mandrels, and said adjusting steps also including controlling said core feed.

5. The method of claim 1 including providing a surface winding type of rewinder equipped with a pair of winding drums and a rider drum arranged in a three drum cradle, said adjusting steps including controlling the speed of at least one of said drums.

6. The method of claim 5 including providing one of said winding drums with a speed profile and controlling said one winding drum speed profile.

7. The method of claim 5 including providing core insertion means for inserting a core between said winding drums.

8. The method of claim 7 including controlling the timing of insertion of said core to function as said cutoff means.

9. The method of claim 5 including providing means for clamping said web on opposite sides of a preselected line of transverse perforation to function as said cutoff means.

10. The method of claim 5 including providing one of said winding drums as a movable drum, and moving said one drum once each cycle.

11. A method for cyclically producing rolls of bathroom tissue or kitchen toweling with a pattern repeated between each pair of adjacent lines of transverse perforation, comprising the steps of advancing along a path toward a rewinder equipped with perforation means and cutoff means an elongated, extensible web having a pattern thereon repeated at equally longitudinally spaced positions, sensing the position of each pattern while generally simultaneously therewith sensing the position of said perforation means, comparing said pattern position with said perforator means position to determine a positional difference, reporting each said positional difference to control means, continuously controlling the position of said perforation means to insure that a succeeding perforation is between pattern positions, and continuously controlling said cutoff means to sever said web at a predetermined line of perforation to provide a preselected count of integral patterns.

12. The method of claim 11 in which said steps include providing a center winding type of rewinder equipped with a rotatable turret carrying a plurality of orbiting, rotatable mandrels with said cutoff means being located adjacent said orbital path of said mandrels, applying a speed of rotation profile cycle sequentially on each of said mandrels, and changing said speed profile cycle to position said predetermined line of perforation at said cutoff means at the end of each said cycle.

13. The method of claim 11 in which said steps include providing a surface winding type of rewinder equipped with rotatable drum means arranged in a three-drum cradle, applying a speed of rotation profile cycle to one of said drums, and changing said speed profile cycle to position said predetermined line of perforation at said cutoff means at the end of each cycle.

14. A rewinder for cyclically winding logs of bathroom tissue or kitchen toweling with a pattern repeated between each pair of adjacent lines of transverse perforation, comprising a frame equipped with perforation means, winding means, cutoff means and means for advancing a pattern-equipped extensible web along a path toward said perforation means, a detector and controller on said frame for sensing the position of each pattern while generally simultaneously therewith sensing the position of said perforation means, means operably associated with said controller and perforation means for adjusting said perforation means to insure that each perforation is between pattern positions, and means operably associated with said controller and cutoff means for adjusting said cutoff means to stay in time with perforations to provide a preselected count of patterns in each winding cycle.

15. The rewinder of claim 14 in which said frame is equipped with means for applying a speed profile cycle on said winding means and for changing said speed profile cycle to position a predetermined line of perforation at said cutoff means at the end of each cycle.

16. The rewinder of claim 15 in which said frame includes a rotatable turret carrying a plurality of orbiting, rotatable mandrels with said cutoff means being located adjacent said orbital path of said mandrels, means on said frame for applying said speed profile cycle sequentially on each of said mandrels and for changing said speed profile cycle to position said predetermined line of perforation at said cutoff means at the end of each said cycle.

17. The method of claim 15 in which said frame includes rotatable drum means arranged in a three-drum cradle, and means on said frame for applying said speed profile cycle to one of said drums and for changing said speed profile cycle to position said predetermined line of perforation at said cutoff means at the end of each cycle.

18. The rewinder of claim 15 in which said cutoff means includes a rotating blade, a cutoff phase actuator operably associated with said cutoff means, and feedback means coupling said controller and cutoff means.

19. The rewinder of claim 15 in which core feed means are mounted on said frame, and feedback means coupling said core feed means with said controller.

20. The rewinder of claim 19 in which said rewinder is a surface winding type equipped with a three-drum cradle including two winding drums providing a nip and a rider drum, said core feed means being arranged to insert a core into said winding drum nip.

21. The rewinder of claim 20 in which said core feed means and controller are coupled by feedback means to position said core adjacent said predetermined line of perforation.

22. The rewinder of claim 15 in which said rewinder is equipped with a pair of drums and a rider drum arranged in a three-drum cradle, said speed profile cycle applying means being coupled to one of said winding drums, said coupling means also including feedback means coupling said applying means to said controller.

23. The rewinder of claim 14 in which said rewinder includes a mandrel-equipped turret rotatably mounted on said frame, means on said frame for rotating said turret, means for separately rotating said mandrels in sequence, and feedback means coupling said mandrel rotating means and said controller.

24. The rewinder of claim 23 in which log stripping means are mounted on said frame, and feed back means coupling said stripping means with said controller.

* * * * *

UNITED STATES PATENT AND TRADEMARK OFFICE

CERTIFICATE OF CORRECTION

PATENT NO. : 5,839,688

DATED : November 24, 1998

INVENTOR(S) : James E. Hertel et al

It is certified that error appears in the above-indentified patent and that said Letters Patent is hereby corrected as shown below:

Col. 9, line 58 delete the third occurrence of "a".

Signed and Sealed this

Twenty-third Day of March, 1999

*Attest:*

Q. TODD DICKINSON

*Attesting Officer*

*Acting Commissioner of Patents and Trademarks*